United States Patent [19]

Freeman

[11] 4,000,757

[45] Jan. 4, 1977

[54] HIGH GAIN FLUID AMPLIFIER

[75] Inventor: Peter A. Freeman, Baltimore, Md.

[73] Assignee: The United States of America as represented by the Secretary of the Navy, Washington, D.C.

[22] Filed: Dec. 4, 1975

[21] Appl. No.: 637,809

[52] U.S. Cl. ..... 137/834; 137/835; 137/836; 137/839; 137/840

[51] Int. Cl.[2] ..... F15C 1/10

[58] Field of Search ..... 137/834, 835, 836, 839, 137/840

[56] References Cited

UNITED STATES PATENTS

| | | | |
|---|---|---|---|
| 3,486,520 | 12/1969 | Hyer et al. | 137/839 X |
| 3,583,419 | 6/1971 | Griffin | 137/836 |
| 3,724,477 | 4/1973 | Rexford | 137/839 X |

*Primary Examiner*—William R. Cline
*Attorney, Agent, or Firm*—R. S. Sciascia; Paul S. Collignon

[57] ABSTRACT

A bistable fluidic amplifier having high gain is disclosed. Power fluid is supplied through an inlet port and lobe-shaped feedback cavities downstream provide an oscillating differential pressure or flow between a pair of outlets. A pair of opposed control ports are provided between the inlet port and the feedback cavities and a differential control pressure or flow applied to the control ports creates a differential outlet pressure or flow having a gain in the range of 10–15.

2 Claims, 7 Drawing Figures

HIGH GAIN FLUID AMPLIFIER

BACKGROUND OF THE INVENTION

The present invention relates to a fluidic amplifier and more particularly to a bistable fluidic amplifier having a high ratio between output and control port input.

Fluid amplifiers and other fluidic components have been known in the art for some time. The inherent simplicity, ruggedness and reliability of fluidic devices make them particularly well suited for use in many control systems.

A basic fluid amplifier amplifies the momentum of an input signal without any moving mechanical parts and is formed by a sandwich-type structure consisting of two plates which serve to confine fluid flow to a planar flow pattern between the two plates. A main or power nozzle extends through an end wall of an interaction chamber and one or more flow dividers are provided, and the sidewalls of the dividers in conjunction with the interaction region sidewalls establish receiving apertures which are entrances to the amplifier output channels. Left and right control orifices extend through the sidewalls and provide control signals for deflecting a power stream.

An oscillating element can be made by incorporating one or more feedback loops so that a small part of the flow is captured in a feedback loop. This flow returns to the interaction region as a control stream which causes the power stream to switch.

SUMMARY OF THE INVENTION

The present invention relates to a fluidic amplifier having high gain. A fluidic element is provided with a venturi type of main flow nozzle and a pair of opposed control ports open into lobe-shaped control cavities near the main flow nozzle exit. A pair of opposed lobe-shaped feedback cavities are provided downstream. A centrally located flow vent is provided and differential outputs are located on each side of the flow vent. In operation, an oscillating differential pressure or flow is provided between the outlets whose average magnitude is proportional to the differential pressure or flow into the control ports.

It is, therefore, a general object of the present invention to provide a fluidic amplifier a high gain ratio between output pressure or flow and input into the amplifier control ports.

Other objects, advantages, and novel features of the present invention will become apparent from the following detailed description of the invention when considered in conjunction with the accompanying drawings.

DESCRIPTION OF THE PREFERRED EMBODIMENT

Figure 1:
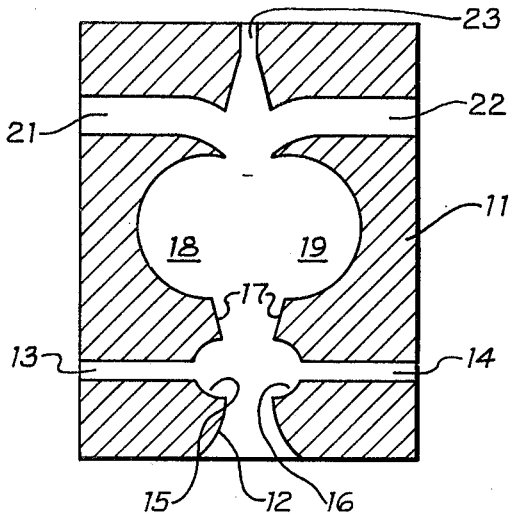
FIG. 1 is a sectional view of a preferred embodiment of the present invention.

Referring now to the drawings, there is shown in FIG. 1 a fluid amplifier 11 constructed in accordance with the present invention. By way of example, amplifer 11 might be of laminar construction and have fluid channels etched or machined in one block and then sealed with a top plate.

A venturi type of main flow nozzle 12 is provided and serves as an inlet means for supplying fluid to amplifier 11. A pair of oppositely disposed control passages 13 and 14 exit into opposed lobe-shaped control cavities 15 and 16 near the main flow nozzle exit. Short sidewalls 17 are provided immediately downstream from the control cavities and maximum sensitivity is achieved with a diversion angle between the sidewall and the amplifier center line of about 20°. By lengthening the sidewall, the effectiveness of the feedback of the amplifier is decreased and also the oscillation frequency is decreased and the amplifier's pressure and flow gains are increased.

A pair of lobe-shaped feedback cavities 18 and 19 are positioned downstream from the sidewalls 17 and provides an oscillating, or alternating, flow through outlets 21 and 22. A centrally located flow vent 23 is provided on the amplifier center line and outlets 21 and 22 are disposed on each side of flow vent 23. The characteristic control frequency must be selected sufficiently higher than the control system response frequency so that the control system does not respond significantly to oscillations in output pressure or flow.

OPERATION

Figure 2A:
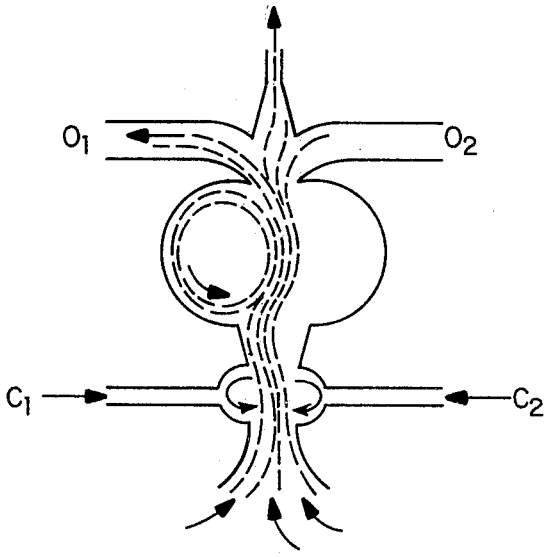
FIG. 2*a* and 2*b* illustrate the fluid flow paths through the device shown in FIG. 1, when the control pressures or flows are equal.
Figure 2B:
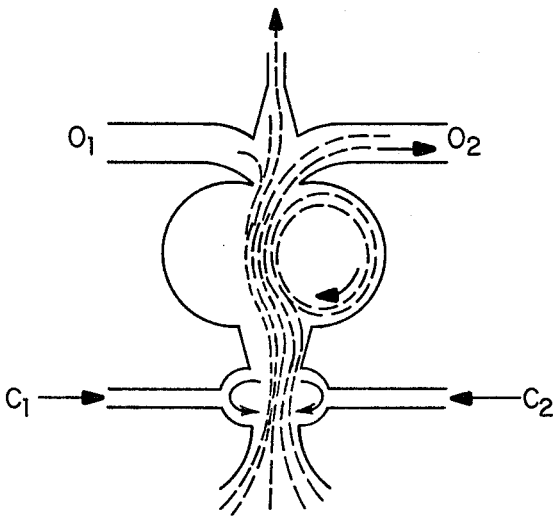
Figure 3:
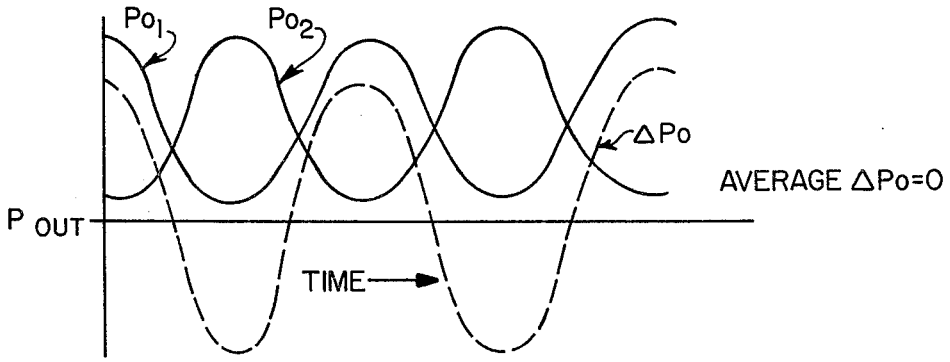
FIG. 3 is a diagram of pressure/flow-time history for the flows shown in FIG. 2*a* and 2*b;*

In operation, consider first that equal pressure and/or flow conditions exist at control ports 13 and 14. The internal flow fields at the peak pressure/flow for outlet 21 ($O_1$) is shown in FIG. 2*a* and the peak pressure/flow for outlet 22 ($O_2$) is shown in FIG. 2*b*. The corresponding pressure/flow time histories are shown in FIG. 3. The feedback effect is accomplished by a portion of the output flow recirculating in one of the feedback cavities, and then impinging on the main flow stream and deflecting it toward the opposite outlet. As shown in FIG. 3, the oscillation flow dynamics are symmetrical with respect to the center line of amplifier 11 and the average differential output pressure/flow is zero.

Figure 4A:
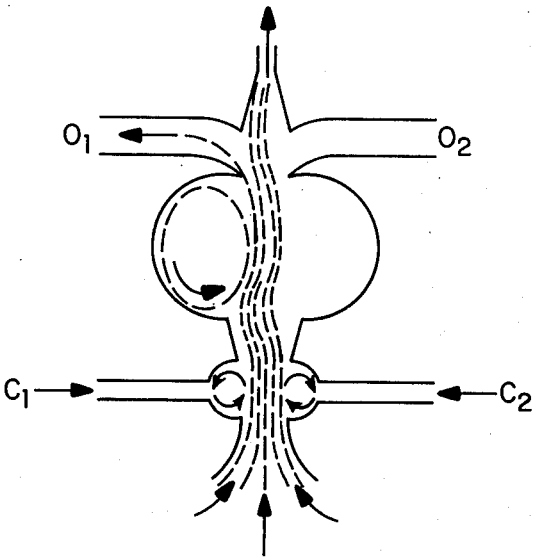
FIG. 4*a* and 4*b* illustrate the fluid flow paths through the device shown in FIG. 1, when the control pressures or flows are unequal.
Figure 4B:
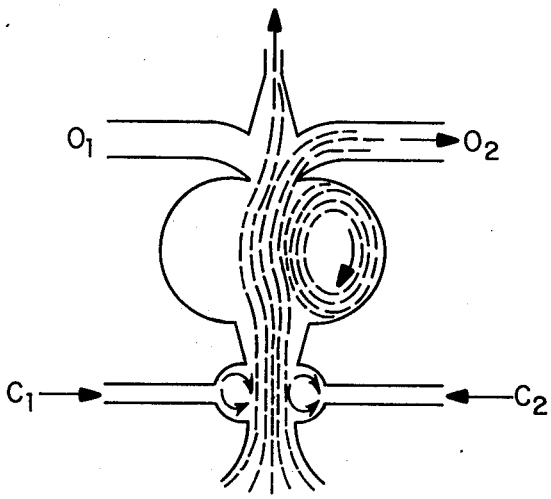
Figure 5:
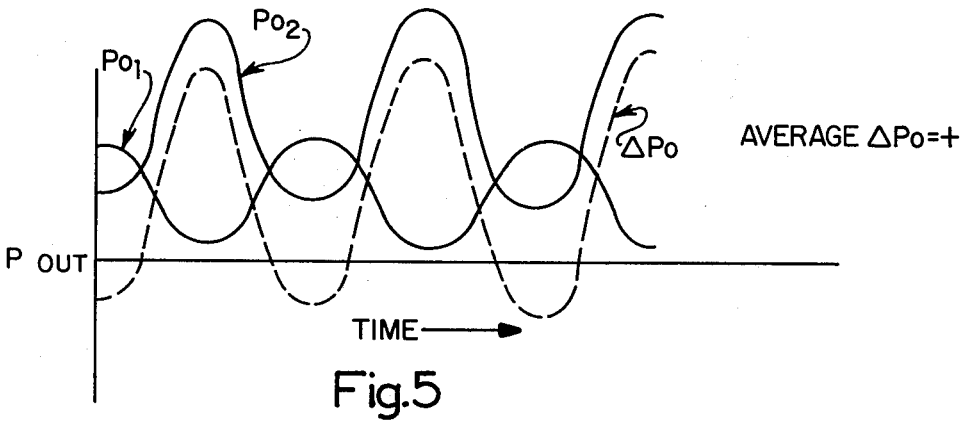
FIG. 5 is a diagram of pressure/flow-time history for the flows shown in FIG. 4*a* and 4*b*.

Referring now to FIGS. 4*a*, 4*b*, and 5 of the drawings, there is shown conditions when a differential control pressure/flow is applied. In FIGS. 4*a* and 4*b*, $C_1$ is greater than $C_2$ and the average differential outlet pressure/flow favors the outlet opposite the higher pressure control port, that is, $O_2$ is greater than $O_1$. The amplifier sensitivity, or gain, can be defined in terms of either pressure gain, $K_p$, or flow gain, $K_Q$, as follows:

$$K_p = \frac{\Delta_{p\ out}}{\Delta_{p\ cont.}} \quad (1)$$

$$K_Q = \frac{\Delta_{Q\ out}}{\Delta_{Q\ cont.}} \quad (2)$$

where $\Delta_{p\ out}$ is the differential pressure of outlets 21 and 22, $\Delta_{Q\ out}$ is the differential flow out of outlets 21 and 22, $\Delta_{p\ cont.}$ is the differential control pressure of passages 13 and 14 and $\Delta_{Q\ cont.}$ is the differential control flow in passages 13 and 14. An amplifier constructed according to the teachings of the present invention will achieve a maximum value of $K_p$ in the range of 10–15, as compared to a conventional fluidic analog amplifier achieving a maximum value of $K_p$ in the range of 3–5. Likewise, a value of $K_Q$ in the range of 10–15 can be achieved with the present invention as compared to a maximum value of 3–5 for a conventional amplifier.

Obviously many modifications and variations of the present invention are possible in the light of the above teachings. It is therefore to be understood, that within the scope of the appended claims, the invention may be practiced otherwise than as specifically described.

I claim:

1. A high gain fluid amplifier comprising, an inlet for supplying power fluid, a centrally located output vent, a pair of differential flow outlets disposed one each on each side of said output vent, a pair of opposed lobe-shaped feedback cavities positioned between said inlet and said outlets for alternately switching fluid to said differential flow outlets, a pair of opposed lobe-shaped control cavities, a pair of control inlets connected one each into said opposed lobe-shaped control cavities for supplying control fluid for controlling movement of power fluid into said output vent and said differential flow outlets, and short angularly disposed sidewalls positioned between said control cavities and said feedback cavities.

2. A high gain fluid amplifier as set forth in claim 1 wherein said inlet is a venturi flow nozzle.

* * * * *